US005795203A

United States Patent [19]

Suppa et al.

[11] Patent Number: 5,795,203

[45] Date of Patent: Aug. 18, 1998

[54] AIR-LAUNCHED BUOY

[75] Inventors: Vito Suppa, Roquefort les Pins; Pascal Bocquillon, Vallauris; Bernard Loubieres, La Colle sur Loup; Gilbert Oddoart, Nice, all of France

[73] Assignee: Thomson-CSF, Paris, France

[21] Appl. No.: 817,099

[22] PCT Filed: Oct. 13, 1995

[86] PCT No.: PCT/FR95/01351

§ 371 Date: Apr. 18, 1997

§ 102(e) Date: Apr. 18, 1997

[87] PCT Pub. No.: WO96/11837

PCT Pub. Date: Apr. 25, 1996

[30] Foreign Application Priority Data

Oct. 18, 1994 [FR] France ..... 94 12411

[51] Int. Cl.[6] ..... B63B 22/00

[52] U.S. Cl. ..... 441/1; 441/30

[58] Field of Search ..... 441/1, 6, 21, 30, 441/31, 32; 244/137.3, 138 R, 146, 147

[56] References Cited

U.S. PATENT DOCUMENTS 3,890,591 6/1975 Bocquillon et al. .

4,029,141 6/1977 Ferrari et al. .

4,279,025 7/1981 Suppa .

4,295,211 10/1981 Suppa et al. .

4,379,534 4/1983 Miller et al. ..... 441/1

4,380,440 4/1983 Suppa .

*Primary Examiner*—Stephen Avila

*Attorney, Agent, or Firm*—Oblon, Spivak, McClelland, Maier & Neustadt, P.C.

[57] ABSTRACT

The invention relates to air-launched buoys intended to be launched from a flying aircraft. It consists, in a buoy the body of which is small and has neither flaps nor inflation opening, in making the connection between the balloon which makes the buoy buoyant and the body leaktight and in placing on the lower part of this balloon a beak of triangular shape allowing air to be caught as the buoy falls towards the water. An opening is made in the wall of the balloon below the beak to allow the air thus caught to enter this balloon in order to inflate it. A non-return valve makes it possible to keep the balloon inflated. It makes it possible to improve the inflation of the balloon and limit the speed at which the buoy falls.

5 Claims, 2 Drawing Sheets

AIR-LAUNCHED BUOY

The present invention relates to air-launched buoys which are intended to be launched from an aircraft so that they float on the surface of the sea while supporting, immersed at a variable depth, measurement sensors the signals from which are generally sent back to the carrier aircraft by radio link. It is applicable, among other things, to undersea detection.

Figure 1:
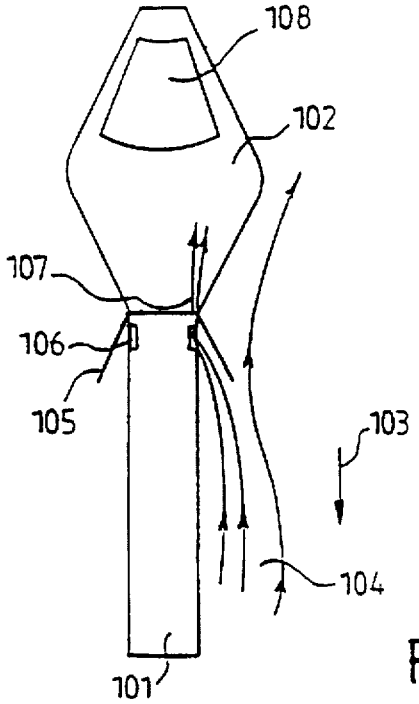
FIG. 1 PRIOR ART

U.S. patent application Ser. No. 78 21 276 filed on 18 Jul. 1978 by the Applicant Company and granted on 15 Feb. 1980 with U.S. Pat. No. 2,431,419 discloses a buoy of this type which includes, as represented in FIG. 1, an elongate body 101 suspended from a balloon 102 of double-frustoconical shape. As it falls through the air in the direction 103, the air streams 104 slip along the body 101, which is relatively long. Most of this air is ducted by two lateral flaps 105 situated at the top end of the body. These flaps open at the moment of launch and their main function is to actuate an internal mechanism which, among other things, releases the protective cap in which the balloon 102 is contained, as described in U.S. patent application Ser. No. 79 05 002 filed by the Applicant Company on 27 Feb. 1979 and granted with the U.S. Pat. No. 2,450,193 on 26 Sept. 1980. These flaps furthermore allow the air streams to be ducted so that they are directed towards openings 106 situated at the upper part of the body below the flaps and which communicate with the inside of the balloon 102 via a non-return diaphragm 107. Thus after launch, the flaps open, which causes the cap protecting the balloon to be ejected and frees the openings 106. The air streams therefore enter through these openings, raise the diaphragm 107 and start to inflate the balloon 102. When the latter is completely inflated it slows the fall of the buoy like a parachute so that the impact on the surface of the water will not be too hard.

The balloon furthermore includes, on the flanks of its upper half, pockets 108 which allow the movement of the buoy to be stabilized as it falls so as to avoid, or at least greatly limit oscillation. For that, these pockets have a triangular shape truncated at the top and they extend over substantially the entire length of the upper frustoconical part of the balloon. They are fixed to the sides and open at top and bottom. Air thus rushes into them, inflates them and escapes through the upper part which therefore acts in the same way as the hole at the centre of a parachute.

When the buoy enters the water, the flow of air stops and the non-return diaphragm 107 closes, which keeps the balloon inflated. This balloon therefore acts as a float which prevents the body from sinking and keeps it close to the water surface. Under the effect of hydrostatic pressure, a small amount of water nevertheless enters the balloon via the openings by lifting the diaphragm 107, but as this balloon is closed at the top, the air pressure increases and prevents water from continuing to enter. The water level inside the balloon therefore stabilizes at a height slightly below the water level outside this balloon.

French Patent Application No. 2,654,065 also discloses a buoy equipped with a balloon.

However, in this patent application, the balloon has no stabilizing pockets situated at its upper part. On the contrary, these pockets are situated on the lower part of the balloon. Also, the air inlets although they are indeed made in the wall of the balloon, are clearly situated at the connection between the body and the balloon and at the base of the pockets.

In these conditions, the air is prevented from reaching the air inlets by the pockets where air builds up on the one hand pushing the air streams beyond the level of the openings and on the other hand pushing the wall of the balloon inwards. In these conditions, the balloon tends initially to deflate a little and then this inflation [sic] stops or continues very slowly, the balloon then looking like a mushroom which acts as a parachute.

As a result of this, on the one hand, the buoy falls very slowly, which is contrary to the desired goal, where although the descent does indeed need to be slowed down enough as not to cause damage when it hits the water, it does however need to be fast enough to be able to be operational as early as possible.

On the other hand, this descent is very unstable because the "parachute" thus obtained has no stabilizing means (the top hole in ordinary parachutes for example) and because on the contrary the pockets which are situated at the bottom tend to accentuate the swinging movements rather than to reduce them.

Technical progress has led to a very substantial reduction in the volume of the hardware contained in the body, and correspondingly to a considerable reduction, of the order of two-thirds, in the length thereof. Furthermore, improvements have made it possible to dispense with the flaps for releasing the balloon after launch.

In these conditions, the movement of the air streams along the body of the buoy is greatly altered and the air is prevented from reaching the air inlets, which leads to the balloon being poorly inflated.

In order to overcome this drawback, the invention proposes an air-launched buoy intended to be launched from a flying aircraft, of the type comprising a body surmounted by an inflatable balloon equipped at its upper part with pockets for aerodynamic stabilization, mainly characterized in that the connection between the body and the balloon is leaktight and in that this balloon at its lower part has at least one beak 205 forming an air intake to allow the balloon to be inflated under the aerodynamic pressure of the air after the buoy has been launched.

According to another feature, the beak has a triangular shape, the opening of which points towards the bottom of the balloon so as to form a scoop for the air and at its upper part it covers an opening made in the wall of the balloon and forming an inlet allowing air into the balloon.

According to another feature, the buoy includes a non-return valve situated on the interior wall of the balloon facing the opening forming an air inlet for the beak.

According to another feature, the beak is formed of a triangular piece of fabric at its lower part having a flexible strip the natural shape of which is curved to allow the beak to be kept open and which can be made to lie flat to allow the balloon to be folded up before the buoy is launched.

According to another feature, the lower part of the beak is situated substantially at one third of the height of the lower frustoconical part of the balloon.

According to another feature, the aerodynamic pockets for stabilization have a small height and an enlarged upper opening to allow the buoy to be fully stabilized as it falls once it has been thrown out of the aircraft.

Figure 2:
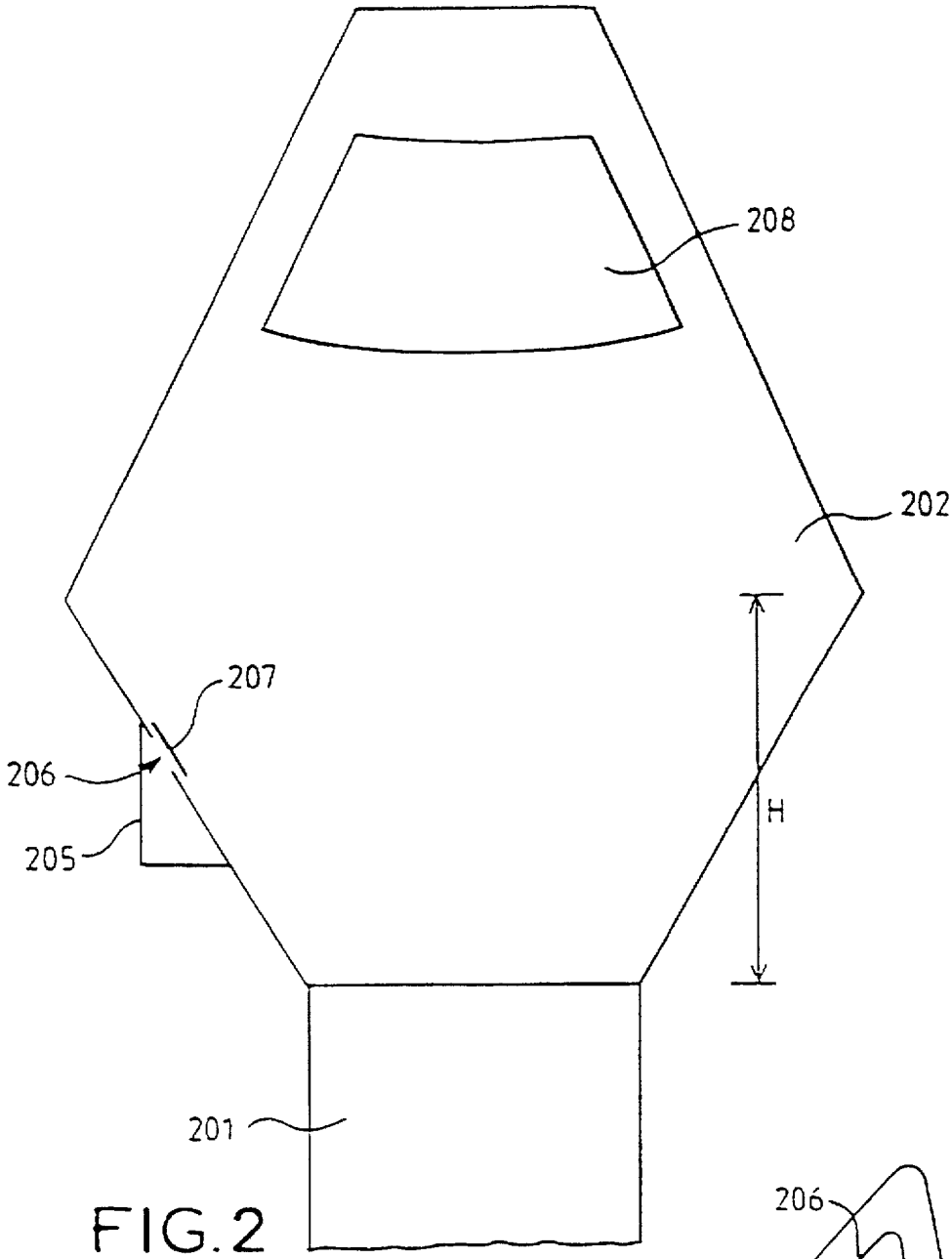
Figure 3:
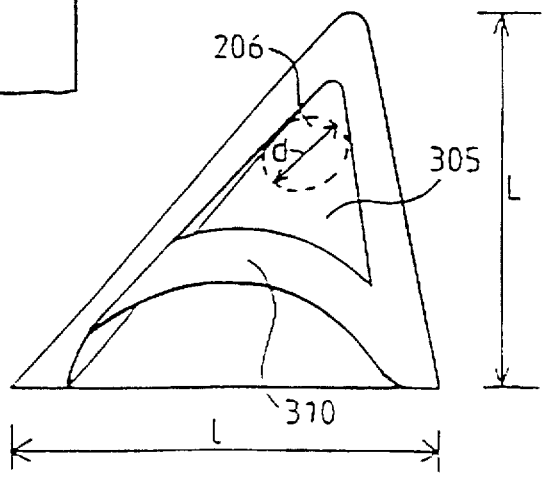

Other singular features and advantages of the invention will become clear from the following description given by way of non-limiting example with reference to the appended figures which represent:

FIG. 1, a side view of a buoy according to the prior art;

FIG. 2, a partial side view of a buoy according to the invention;

FIG. 3, a view of the beak of the buoy of FIG. 3; and

Figure 4:
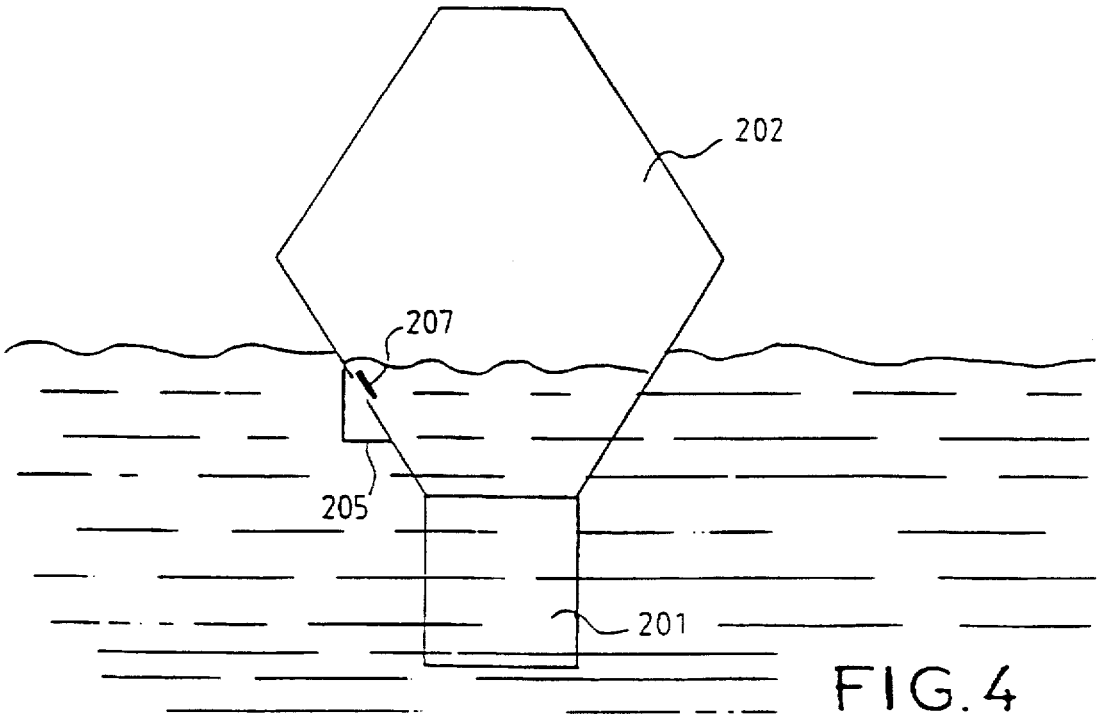

FIG. 4, a sectional view through a buoy according to the invention floating on the sea.

The buoy according to the invention, represented partially and diagrammatically in FIG. 2, comprises a body 201 which is truncated in the drawing and the length of which is substantially equal to one third of the length of the body 101 of the buoy according to the prior art. This body has neither openings at its upper part, nor flaps, contrary to the one represented in FIG. 1.

The buoy further includes a balloon 202 of double-frustoconical shape which in shape and size is very much like the one of the prior art.

This balloon is equipped at its upper part with stabilization pockets 208 the appearance and function of which are similar to those of the pockets of the prior art but the dimensions of which are, according to the invention, markedly smaller in terms of height and the upper opening of which is markedly broader.

Furthermore, as the body no longer has any air inlet openings, the connection between the balloon and the body is leaktight to avoid any air leaks at this point.

In order for it still to be possible to inflate the balloon without resorting to complicated and expensive internal means, of the inflation bottle kind, the invention proposes to place at the lower part of the balloon, at least one beak 205 forming an air intake and which covers an opening 206 pierced in the wall of the balloon and forming an air inlet. This opening is closed on the inner face of the balloon by a non-return valve 207 represented diagrammatically in the figure.

This beak is represented in greater detail in FIG. 3.

It is therefore formed of a piece of fabric 305 of triangular shape, the tip of which points towards the top of the balloon and which is fixed by bonding or welding to the exterior surface thereof via its two lateral sides. The fabric is preferably the same as that of the balloon.

To be absolutely certain that this piece will deploy upon extraction of the balloon, a pliable strip 310 made of flexible plastic for example, which can be made to lie flat when the balloon is folded up to be placed in its protective cap when the buoy is being manufactured, has been fixed to the lower part of the triangle. When the cap is ejected and the balloon unfolds the flexible strip resumes its natural bowed shape and gives the triangular piece of fabric the shape of a scoop so that air easily rushes into it. This air then enters the balloon through a circular opening 206 situated at the tip of the triangle formed by the beak.

The non-return valve situated on the inside of the balloon is preferably formed by a rectangular piece of fabric of the same type as that of the balloon, bonded or welded by two of these [sic] opposite sides to the interior surface of the balloon so that it covers the opening 206. This valve thus makes it possible to limit the flow rate of air admitted during the inflation of the balloon after it is thrown out of the carrying aircraft, which limits the risks of this balloon bursting as it inflates. Furthermore, when the buoy is floating on the surface of the water, as represented in FIG. 4, a small amount of water enters it, as already explained in the description of the prior art, and the non-return valve stops this water, as well as possibly any air, from coming back out when the balloon is shaken violently by a breaking wave. Thus the buoyancy of the buoy is maintained even in stormy weather.

The phase of inflation of the balloon as the buoy is thrown out of the carrying aircraft is also controlled and the life of the buoy in heavy seas is guaranteed.

For a standard buoy, the frustoconical lower part of the balloon of which has a height H substantially equal to 250 mm, good results have been obtained by positioning three beaks of this type at 120° from one another. These beaks had a height of substantially 90 mm for a base opening of substantially 60 mm, and the diameter of the air inlet opening was substantially 24 mm. The base of the triangle was positioned level with the lower third of the lower frustum forming the balloon.

Moreover, by reducing the dimensions of the aerodynamic stabilization pockets 208 to one half of the height of the known pockets and by enlarging their upper opening by approximately one third, it becomes possible to absorb all the turbulence in the flow around the balloon.

In these conditions, for a currently existing buoy weighing 4.3 kg it is possible to achieve a limiting rate of fall of the order of 32 m/s, which substantially reduces the stresses applied to the buoy as it hits the surface of the water, by comparison with those observed for current rates which are of the order of 40 m/s. The origin of these excessive rates is as a result of the fact that the inflation is essentially obtained, when the flaps are dispensed with, by the aerodynamic overpressure arising from the speed of the aircraft, which is exerted on the buoy from the side. A progressive loss of air during the descent is therefore obtained, and this is only partially compensated for by the oscillations of the buoy on its path.

The observations made showed that the inflation of the balloon with this type of beak is fully reproducible from one buoy to another. The buoy is therefore perfectly fitted to its purpose.

We claim:

1. Air-launched buoy intended to be launched from a flying aircraft, of the type comprising a body surmounted by an inflatable balloon equipped at its upper part with pockets for aerodynamic stabilization, and at its lower part including an air intake to allow the balloon to be inflated, wherein the connection between the body and the balloon is leaktight and in that the air intake is composed of at least one beak having a triangular shape, the opening of which points towards the bottom of the balloon so as to form a scoop for the air, and in that at its upper part this scoop covers an opening made in the wall of the balloon and forming an inlet allowing air into the balloon.

2. Buoy according to claim 1, further comprising a non-return valve situated on the interior wall of the balloon facing the opening forming an air inlet for the beak.

3. Balloon according to claim 2, wherein the beak is formed of a triangular piece of fabric having at its lower part a flexible strip the natural shape of which is curved to allow the beak to be kept open and which can be made to lie flat to allow the balloon to be folded up before the buoy is launched.

4. Buoy according to claim 3, wherein the lower part of the beak is situated substantially at one third of the height of the lower frustoconical part of the balloon.

5. Buoy according to claim 4, wherein the aerodynamic pockets for stabilization have a small height and an enlarged upper opening to allow the buoy to be fully stabilized as it falls once it has been thrown out of the aircraft.

* * * * *